US005721179A

United States Patent [19]

Shi et al.

[11] Patent Number: 5,721,179

[45] Date of Patent: Feb. 24, 1998

[54] CUT RESISTANT FABRIC, APPAREL, AND YARN

[75] Inventors: Lie Shi, Charlotte, N.C.; Ralph Stephen Blake, Lake Wylie, S.C.

[73] Assignee: Hoechst Celanese Corporation, Somerville, N.J.

[21] Appl. No.: 594,603

[22] Filed: Feb. 2, 1996

[51] Int. Cl.[6] ..... D02G 3/00; D02G 13/00; D02G 3/02

[52] U.S. Cl. ..... 442/203; 442/228; 442/208; 442/304; 428/377; 428/222; 57/210; 57/216; 57/224

[58] Field of Search ..... 428/257, 224, 428/229, 370, 101, 222, 377; 442/304, 316, 228, 203, 208; 57/210, 216, 224

[56] References Cited

U.S. PATENT DOCUMENTS

| | | | |
|---|---|---|---|
| 3,883,898 | 5/1975 | Byrnes, Sr. | 2/167 |
| 4,004,295 | 1/1977 | Byrnes, Sr. | 2/161 R |
| 4,384,449 | 5/1983 | Byrnes, Sr. et al. | 57/210 |
| 4,470,251 | 9/1984 | Bettcher | 57/230 |
| 4,651,514 | 3/1987 | Collett | 57/227 |
| 4,777,789 | 10/1988 | Kolmes et al. | 57/210 |
| 4,825,470 | 5/1989 | Horio | 2/21 |
| 4,838,017 | 6/1989 | Kolmes et al. | 57/210 |
| 4,886,691 | 12/1989 | Wincklhofer | 428/224 |
| 4,912,781 | 4/1990 | Robins et al. | 2/167 |
| 4,989,266 | 2/1991 | Borgese et al. | 2/2.5 |
| 5,070,540 | 12/1991 | Bettcher et al. | 2/2.5 |
| 5,119,512 | 6/1992 | Dunbar et al. | 2/167 |
| 5,177,948 | 1/1993 | Kolmes et al. | 57/229 |
| 5,248,548 | 9/1993 | Toon | 428/222 |
| 5,287,690 | 2/1994 | Toon | 57/210 |
| 5,431,979 | 7/1995 | Dellinger et al. | 428/101 |
| 5,442,815 | 8/1995 | Cordova et al. | 2/161.7 |

FOREIGN PATENT DOCUMENTS

| | | |
|---|---|---|
| 458 343 A1 | 11/1991 | European Pat. Off. . |
| 595 320 A1 | 5/1994 | European Pat. Off. . |

*Primary Examiner*—Newton Edwards
*Attorney, Agent, or Firm*—R. H. Hammer, III; M. B. Dearth

[57] ABSTRACT

A cut resistant fabric is made from woven or knitted yarn; the yarn includes a cut resistant fiber having a tenacity of less than about 10 grams/denier. A cut resistant fabric is made from woven or knitted yarn. The yarn includes a polyethylene fiber having a tenacity of less than about 10 grams/denier and a molecular weight of about 100,000. The yarn may be in the form of a composite yarn having a core and a wrap. The polyethylene fiber is in the wrap.

7 Claims, No Drawings

CUT RESISTANT FABRIC, APPAREL, AND YARN

FIELD OF THE INVENTION

The present invention is directed to a cut resistant/protective fabric, articles of apparel made therefrom, and the yarn for making the fabric.

BACKGROUND OF THE INVENTION

Cut resistant/protective fabric and articles of apparel made therefrom are known. For example, see: U.S. Pat. Nos. 3,883,898; 4,004,295; 4,384,449; 4,470,251; 4,651,514; 4,777,789; 4,825,470; 4,838,017; 4,912,781; 4,989,266; 5,070,540; 5,119,512; 5,177,948; 5,248,548; 5,287,690; 5,442,815; and European Publications 458,343 and 595,320.

In U.S. Pat. No. 3,883,898, the cut resistant/protective fabric is made from woven or knitted aramid yarn. In U.S. Pat. No. 4,384,449, the cut resistant/protective fabric is made from a composite yarn that is composed of a core, e.g. longitudinally extending filaments, and a wrap, i.e. fibers or yarn wrapped around the core. This composite yarn has a core of a flexible wire alongside an aramid fiber strand and a wrap of an aramid fiber. In U.S. Pat. No. 4,470,251, the cut resistant/protective fabric is made from a composite yarn. This composite yarn has a core of two annealed stainless steel wires and a high strength aramid fiber, and a multi-layered wrap having a bottom layer of an aramid fiber and a top layer of a nylon fiber. In U.S. Pat. No. 5,119,512, one of the cut resistant/protective fabrics is made from a composite yarn. This composite yarn is made from at least two non-metallic fibers; one fiber has a high level of hardness, and the other is an inherently cut resistant fiber like a polyethylene fiber such as Spectra® 900 or Spectra® 1000. This patent also discloses that man-made synthetic fibers may be used in both the core and the wrap. In U.S. Pat. No. 5,442,815, the cut resistant/protective fabric is made from a composite yarn having a core of an elastomeric (Spandex) fiber, and a wrap of a cut resistant fiber. This cut resistant fiber has a tenacity of at least 15 grams/denier.

Spectra® polyethylene fibers are commercially available from AlliedSignal Corporation, Petersburg, Va. These fibers are referred to as "extended-chain polyethylene" (ECPE) or "ultrahigh molecular weight polyethylene" (UHMWPE). Spectra® 1000 has a molecular weight (Mn) of 1,500,000; a breaking strength (e.g. tenacity) of 3.0 GPa; and a modulus of 170 GPa.

To date, the general belief among cut resistant/protective fabric makers and their fiber supplier is that to obtain good cut resistance, one must have a "high strength" fiber, hence the use of KEVLAR® aramids, VECTRAN® liquid crystal polymers, SPECTRA® ECPEs, and the like. These products are relatively expensive. Accordingly, there is a need for a less expensive, but effective, cut resistant fabric.

SUMMARY OF THE INVENTION

A cut resistant fabric is made from woven or knitted yarn; the yarn includes a cut resistant fiber having a tenacity of less than about 10 grams/denier. A cut resistant fabric is made from woven or knitted yarn. The yarn includes a polyethylene fiber having a tenacity of less than about 10 grams/denier and a molecular weight of about 100,000. The yarn may be in the form of a composite yarn having a core and a wrap. The polyethylene fiber is in the wrap.

DESCRIPTION OF THE INVENTION

Cut resistant and/or protective fabrics and articles of apparel made therefrom are described in U.S. Pat. Nos. 3,883,898; 4,004,295; 4,384,449; 4,470,251; 4,651,514; 4,777,789; 4,825,470; 4,838,017; 4,912,781; 4,9898,266; 5,070,540; 5,119,512; 5,177,948; 5,248,548; 5,287,690; 5,442,815; and European Publications 458,343 and 595,320. Each of the foregoing is incorporated herein by reference.

The cut-resistant fabric is preferably made from woven or knitted composite yarns. Preferably, the fabric is knitted. The composite yarn comprises a core and a wrap. The core may comprise one or more fibers of similar or dissimilar materials. The core fibers may be selected from the group consisting of metal wire, fiberglass, man-made synthetic fibers, and combinations thereof. The wrap may comprise one or more fibers of similar or dissimilar materials. The wrap may have one or more layers of fibers. The wrap fibers may be selected from the group consisting of metal wire, fiberglass, man-made synthetic fibers, and combinations thereof.

Man-made synthetic fibers include, but are not limited to, the following fibers identified by their generic names: acrylic, modacrylic, polyester, rayon, acetate, saran, azlon, nytril, nylon, rubber, spandex, vinal, olefin, vinyon, metallic, glass, anidex, novoloid, aramid, surfar, and PBI. Also included in the foregoing are man-made synthetic polymers that are doped or loaded with materials that enhance the cut-resistant properties of the fibers.

The cut resistant fiber referred to herein is preferably a high performance fiber. The cut-resistant fiber has a tenacity of less than about 10 grams/denier. The preferred cut-resistant, high performance fiber is a polyolefin fiber, e.g. polyethylene fiber. The polyethylene fiber has a molecular weight of about 100,000 and a tenacity of less than about 10 grams/denier. This polyethylene fiber specifically excludes SPECTRA® fiber and conventional high density polyethylene (HDPE) fibers. Conventional high density polyethylene fibers are characterized as having tenacities of less than 6 grams/denier. Polyethylene fibers with molecular weights greater than 150,000, or with tenacities greater than 15 grams/denier, are also excluded from the material claimed herein. The preferred polyethylene fiber is CERTRAN® M fiber which is commercially available from Hoechst Celanese Corporation of Charlotte, N.C.

Below are disclosed three non-limiting examples of composite yarns that may be used in the inventive cut-resistant fabrics.

A 10-gauge composite knitting yarn having a core and a wrap is disclosed. The core consists of: 1) a 500 denier polyester yarn (HCC's type 787 Trevira® polyester); and 2) a monofilament stainless steel wire (0.003 inch diameter), neither 1) nor 2) is twisted. The bottom wrap, surrounding the core, consists of CERTRAN® M high performance fibers wrapped in the "Z" direction with 11 turns per inch (TPI). The top wrap, surrounding the bottom wrap, consists of 500 denier polyester yarn (HCC's Type 787 Trevira® polyester) wrapped in the "S" direction with 11 turns per inch (TPI).

A 7-gauge composite knitting yarn having a core and a wrap is disclosed. The core consists of: 1) a 500 denier polyester yarn (HCC's Type 787 Trevira® polyester); and 2) a monofilament stainless steel wire (0.003 inch diameter), neither 1) nor 2) is twisted. The bottom wrap, surrounding the core, consists of two wraps, one on top of the other: 1) a monofilament stainless steel wire (0.003" inch diameter) with a "Z" twist of 9 turns per inch (TPI), and 2) CERTRAN® M high performance fibers with a "S" twist of 10 turns per inch (TPI). The top wrap, surrounding the bottom wrap, consists of two wraps, one on top of the other: 1) a 500 denier polyester yarn (HCC's Type 787 Trevira® polyester) with a "Z" twist of 6 turns per inch (TPI); and 2) a 1000 denier polyester yarn (HCC's Type 787 Trevira® polyester) with a "S" twist of turns per inch (TPI).

Cut resistance of the foregoing yarns demonstrated that their cut resistance was the same as that of yarns made with "high strength" polyethylene yarns or fibers (e.g. polyethylene yarns made with Spectra® or CERTRAN® HMPE). This is contrary to the conventionally held wisdom that cut resistance is a function of fiber strength. Additionally, it would appear to suggest that cut resistance is not a function of molecular weight.

As an example of the foregoing comparison of the cut-resistance between the three yarns discussed, the following test results are set forth (See Table 1).

TABLE 1

| | Hoseleg (denier) | Tensile Strength (g/denier) | Cut Resistance (pounds) |
|---|---|---|---|
| CERTRAN M | 1300 | 9.9 | 2.3 |
| CERTRAN HMPE | 1300 | 15.1 | 2.0 |
| SPECTRA 1000 | 1300 | 32.2 | 2.3 |

The samples were prepared as follows: polyethylene yarns were plied to obtain yarns with comparable deniers for hoseleg preparation. Hoselegs of each yarn type were knit with a 4 inch diameter 18 guage head with a yarn tension setting of 3.8. The cut resistance test was conducted as follows using a Sintech tensile tester: The circular hoseleg was cut lengthwise to produce flat fabric. A 10 inch length of the flat fabric is pre-tensioned to 2 pounds resisitance with ½ inch distortion over a 6 inch diameter tube. The fabric is positioned at 45° relative to the position of the cutting force. A stationery 2 inch diameter blade is forced toward the fabric at 5 inches per minute. The force in pounds to cut the first threadline is recorded. The average cut resistance of each fabric is determined by measuring resistance to being cut in the parallel, perpendicular and diagonal direction relative to the knit.

An elastomeric composite yarn having a core and a wrap is disclosed. The core comprises a spandex fiber, for example, LYCRA® spandex from DuPont of Wilmington, Del. The wrap comprises the polyethylene fiber disclosed herein.

The present invention may be embodied in other specific forms without departing from the spirit or essential attributes thereof and, accordingly, reference should be made to the appended claims, rather than to the foregoing specification, as indicating the scope of the invention.

We claim:

1. A cut resistant fabric comprising: a woven or knitted yarn, said yarn comprising a polyethylene fiber having a tenacity of less than 10 grams/denier.

2. The fabric according to claim 1 wherein said yarn further comprises a core and a wrap, wherein said polyethylene fiber is contained in said wrap.

3. The fabric according to claim 2 wherein said core comprises a fiber selected from the group consisting of: metal wire, fiberglass, man-made synthetic fiber, and combinations thereof.

4. The fabric according to claim 2 wherein said wrap further comprises a fiber selected from the group consisting of: metal wire, fiberglass, man-made synthetic fiber, and combinations thereof.

5. The fabric according to claim 2 wherein said wrap comprises multiple layers.

6. A cut resistant fabric comprising: a woven or knitted composite yarn; said composite yarn having a core and a wrap; said core comprising a fiber selected from the group consisting of metal wire, fiberglass, man-made synthetic fiber, and combinations thereof; said wrap comprising a polyethylene fiber having a tenacity of less than 10 grams/denier.

7. An article of cut resistant apparel comprising the fabric set forth in claims 2–6.

* * * * *